US006745748B2

(12) United States Patent
Kobayashi

(10) Patent No.: US 6,745,748 B2
(45) Date of Patent: Jun. 8, 2004

(54) FAIL-SAFE SYSTEM FOR COMBUSTION ENGINE CONTROL

(75) Inventor: Hidetoshi Kobayashi, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/022,193

(22) Filed: Dec. 20, 2001

(65) Prior Publication Data

US 2002/0078925 A1 Jun. 27, 2002

(30) Foreign Application Priority Data

Dec. 27, 2000 (JP) ..... 2000-399245

(51) Int. Cl.[7] ..... F02P 5/00
(52) U.S. Cl. ..... 123/406.18; 123/406.13
(58) Field of Search ..... 123/406.18, 406.13, 123/479, 352, 612, 406.62

(56) References Cited

U.S. PATENT DOCUMENTS 4,664,082 A * 5/1987 Suzuki ..... 123/406.18
4,787,355 A 11/1988 Maeda
4,791,900 A * 12/1988 Buck et al. ..... 123/359
5,269,274 A * 12/1993 Flaetgen et al. ..... 123/406.62
5,469,823 A * 11/1995 Ott et al. ..... 123/406.62
5,671,145 A 9/1997 Krebs et al.
6,016,789 A 1/2000 Denz et al.
2001/0019267 A1 9/2001 Shimizu et al.

FOREIGN PATENT DOCUMENTS

EP 43 3 33 A1 10/1994
JP 2000-104619 4/2000

* cited by examiner

*Primary Examiner*—Mahmoud Gimie
(74) *Attorney, Agent, or Firm*—Nixon & Vanderhye P.C.

(57) ABSTRACT

An engine control system executes given control tasks, for example, at a 30° angular interval of an engine crank shaft. If a failure of a crank sensor has occurred, it becomes impossible to determine the 30° angular interval of the crank shaft. In this case, the engine control system works to calculate one-third of an interval (e.g., a 90° crank angle) between consecutive inputs of cam angular position signals to define a dummy 30° crank angle as a trigger for initiating the control tasks. If the cam angular position signal is inputted before the number of times the control tasks should be executed, in sequence, at an interval of the dummy 30° crank angle is not yet reached, each of the control tasks is executed immediately the same number of times as that the control task has not yet been executed at the dummy 30° crank angle time interval.

4 Claims, 12 Drawing Sheets

FAIL-SAFE SYSTEM FOR COMBUSTION ENGINE CONTROL

BACKGROUND OF THE INVENTION

1. Technical Field of the Invention

The present invention relates generally to an internal combustion engine control system, and more particularly to a fail-safe system for automotive engine control designed to ensure execution of given control tasks in the even of a failure of a mechanism working to produce triggers for initiating the given control tasks.

2. Background Art

Japanese Patent First Publication No. 2000-104619 discloses an internal combustion engine control system which works to define a fraction of an output interval of first and second cam signals from first and second cam sensors as a control task trigger interval and estimate an acceleration or deceleration of the engine to correct the control task trigger interval with suitable weighting to determine a dummy control task start time instead of a control task start time defined by a crank signal for initiating a control task such as fuel injection control or ignition timing control if a failure of a crank sensor has occurred.

A typical cam sensor installed in an automotive internal combustion engine is constructed to output a cam angular position signal one time every combustion cycle of each cylinder of the engine. The above described engine control system is designed for a V-type four-cycle eight-cylinder engine. The first and second cam sensors output the first and second cam signals at an interval of 90° crank angle (CA). In a case of a four-cycle four-cylinder engine, cam signals are outputted at an interval of 180° CA. It is, thus, difficult for the above prior art engine control system to estimate the degree of acceleration or deceleration of the engine accurately using the cam signals outputted at such a long time interval. Therefore, even if the control task trigger interval is corrected with suitable weighting to determine the dummy control task start time, it is possible that when the engine is accelerated rapidly, the establishment of the dummy control task start time may be too late. This will result in a difficulty in executing the control task a given number of times within a desired angular interval of revolution of the engine.

SUMMARY OF THE INVENTION

It is therefore a principal object of the invention to avoid the disadvantages of the prior art.

It is another object of the invention to provide an engine control system which is capable of ensuring execution of a given control task within a desired angular interval of revolution of the engine in the even of a failure of a mechanism working to produce a trigger for initiating the control task.

According to one aspect of the invention, there is provided a control apparatus for an internal combustion engine. The control apparatus comprises: (a) a crank sensor responsive to rotation of a crank shaft of an internal combustion engine to output a crank signal at a first angular interval of the rotation of the crank shaft; (b) a cam sensor responsive to rotation of a cam shaft of the engine to output a cam signal at a second angular interval of the rotation of the cam shaft which is a given multiple of the first angular interval of the rotation of the crank shaft; (c) a crank sensor failure detecting circuit detecting a failure of the crank sensor to provide a failure signal indicative thereof; (d) a control circuit executing a given control task cyclically in synchronism with rotation of the engine; and (e) a control task start time defining circuit working to define a crank signal-triggered control task start time at which the given control task is to be initiated cyclically in the control circuit as a function of an interval between sequential inputs of the crank signals from the crank sensor. If the crank sensor has failed, the control task start time defining circuit is responsive to the failure signal from the crank sensor failure detecting circuit to define a cam signal-triggered control task start time at which the given control task is to be initiated every input of the cam signal from the cam sensor and also to define a given fraction of an interval between sequential inputs of the cam signals as a dummy crank signal-triggered control task start time interval at which the given control task is to be executed following the input of the cam signal. If the cam signal is inputted before the number of times the control task is to be executed cyclically at the dummy crank signal-triggered control task start time interval is not yet reached, the control task start time defining circuit produces at least one trigger to initiate the given control task following execution of the given control task upon the input of the cam signal. This ensures the stability of an operating condition of the engine in the even of the failure of the crank sensor.

If the cam signal is inputted before the number of times the control task is to be executed cyclically at the dummy crank signal-triggered control task start time interval is not yet reached, the control task start time defining circuit may produce triggers in response to the input of the cam signal to initiate the given control task the same number of times as that the given control task is not yet executed at the dummy crank signal-triggered control task start time interval. This achieves execution of the control task a required number of times between two consecutive outputs of the cam signals to ensure the stability of an operating condition of the engine in an emergency running mode.

The control task start time defining circuit may define the dummy crank signal-triggered control task start time interval only when the speed of the engine is less than a given value.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
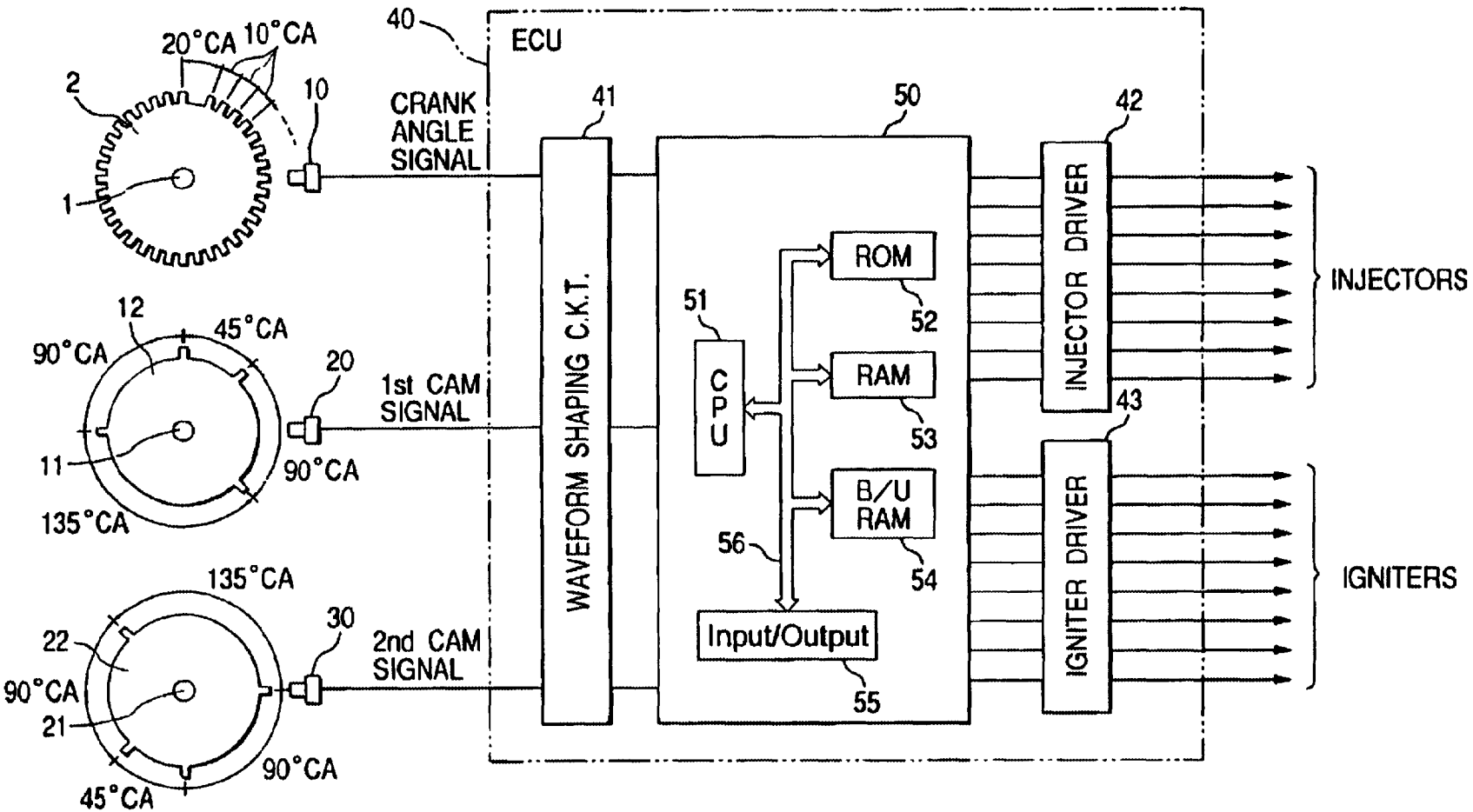
FIG. 1 is a block diagram which shows an engine control system according to the invention.

Referring to the drawings, wherein like reference numbers refer to like parts in several views, particularly to FIG. 1, there is shown an engine control system according to the invention which may be employed in controlling operations of automotive internal combustion engines.

The engine control system generally includes a crank sensor 10, a first cam sensor 20, and a second cam sensor 30, and an electronic control unit (ECU) 40.

The crank sensor 10 works to measure an angular position (will also be called a crank angle CA below) of a crank shaft 1 of a V-type four-cycle eight-cylinder engine (not shown) and outputs a crank angle signal indicative thereof to the ECU 40. The crank shaft 1 has disposed thereon a rotary disc 2 which has 35 (36-1) protrusions or teeth formed on the periphery thereof at a regular internal of 10°. However, only one of the intervals between the teeth is, as clearly shown in the drawing, 20°. The crank sensor 10 is oriented to the teeth of the rotary disc 2 and implemented by an electromagnetic pickup working to produce a signal (i.e., the crank angle signal) upon passage of each of the teeth.

The first cam sensor 20 measures an angular position of a first cam shaft 11 for a first bank of four cylinders provided in one of two cylinder blocks of the V-type engine. The first cam shaft 11 has disposed thereon a rotary disc 12 which has four protrusions or teeth arranged on the periphery thereof at illustrated irregular intervals. The first cam sensor 20 is oriented to the teeth of the rotary disc 12 and implemented, like the crank sensor 10, by an electromagnetic pickup which produces a first cam signal every passage of the teeth.

Similarly, the second cam sensor 30 measures an angular position of a second cam shaft 21 for a second bank of four cylinders provided in the other cylinder blocks of the V-type engine. The second cam shaft 21 has disposed thereon a rotary disc 12 which has four protrusions or teeth arranged on the periphery thereof at illustrated irregular intervals. The second cam sensor 30 is oriented to the teeth of the rotary disc 22 and implemented by an electromagnetic pickup which produces a second cam signal every passage of the teeth.

Specifically, either of the first and second cam sensors 20 and 30 outputs one of the first and second cam signals every 45° rotation of the first and second cam shafts 11 and 21. Each of the first and second cam shafts 11 and 21 makes a complete turn (i.e., 360°) every two rotation (i.e., 720° CA) of the crank shaft 1. Therefore, the crank angle signal is outputted from the crank sensor 10 at an angular interval of 10° CA, while either of the first and second cam signals is outputted from the first or second cam sensor 20 and 30 every 90°, as expressed by the crank angle CA. The V-type engine of this embodiment is designed to carry out control tasks, as will be described later in detail, in synchronization with revolution of the engine. In this embodiment, as examples, ignition control, fuel control tasks, etc. are initiated every third crank angle signal, that is, every 30° CA. Specifically, each of the ignition control and the fuel injection control tasks is executed three times between two consecutive outputs of the first and/or second cam signals from the first and second cam sensors 20 and 30.

The ECU 40 consists of a waveform shaping circuit 41, a microcomputer 50, an injector driver 42, and an igniter driver 43. The signals outputted from the crank sensor 10 and the first and second cam sensors 20 and 30 enter the microcomputer 40 through the waveform shaping circuit 41. The microcomputer 50 calculates controlled variables based on an operating condition of the engine determined by signals from a variety of sensors (not shown) in response to input of the crank angle signal and the first and second cam signals and provides drive signals to the injector driver 42 and the ignition driver 43. The injector driver 42 works to output an ignition control signal to each injector (not shown) installed in the engine. The igniter driver 43 works to output an igniter control signal to each igniter (not shown) of the engine.

The microcomputer 50 is implemented by an arithmetic logic unit which consists of a CPU 51, a ROM 52 storing control programs, a RAM 53 storing control data, a B/U (Back Up) RAM 54, an input/output circuit 55, and a bus line 56 connecting them.

Figure 2:
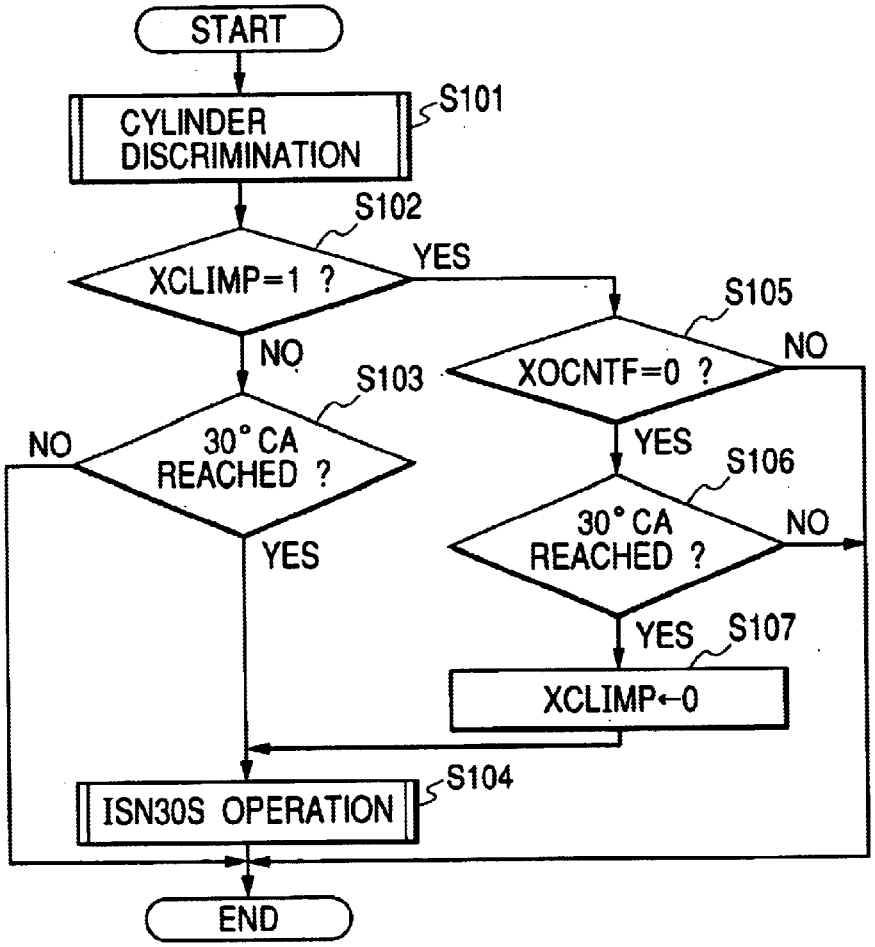
FIG. 2 shows a flowchart of a main program to initiate given engine control tasks in a CPU of the engine control system of FIG. 1.
Figure 3:
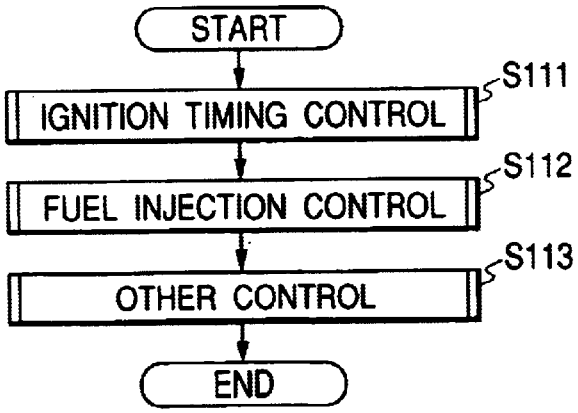
FIG. 3 shows a flowchart of a program to execute given control tasks.

FIG. 2 shows a main engine control program performed by the CPU 51 in the microcomputer 50 of the ECU 40 when the crank sensor 10 works to output the crank angle signals in a normal state. This program is executed every input of the crank angle signals (i.e., every 10° CA except where the crank angle signals are outputted once at an interval of 20° CA in each rotation of the crank shaft 1). FIG. 3 shows a set of control tasks executed in step 104 of FIG. 2 at an interval of 30° CA, which will also be referred to as an ISN20S operation below. In the following discussion, it is assumed that the first and second cam sensors 20 and 30 are both in service.

After entering the program of FIG. 2, the routine proceeds to step 101 wherein a cylinder discriminating operation is performed. Specifically, a crank angle counter value CCENK and an interrupt time ZTNE, i.e., a control task start time where the ISN30S operation should be initiated are determined. The crank angle counter value CCRNK is imcremented at an interval of dummy 30° CA, (T30), dummy 90° CA (T90), as will be described later in detail, or actual 30° CA which is required for initiating the ISN30S operation (i.e., the ignition timing control and the fuel injection control) and set to a given reference value when a reference one of the cylinders of the engine is detected. The interrupt time ZTNE is provided at an interval of 30° CA determined using the crank angle signals.

The routine proceeds to step 102 wherein it is determined whether an emergency running mode flag XCLIMP indicating that the vehicle is now in an emergency running mode is one (1) or not. The emergency running mode is a mode which ensures self-running of the vehicle to an auto repair shop when a failure of the crank sensor 10 occurs. If a NO answer is obtained meaning that the emergency running mode flag XCLIMP indicates zero (0), that is, that the vehicle is not in the emergency running mode, then the routine proceeds to step 103 wherein it is determined whether the current crank angle is 30° or not. If a YES answer is obtained, then the routine proceeds to step 104 wherein the ISN30S operation, as will be described in FIG. 3, is performed by interrupt at an interval of 30° CA. Alternatively, if a NO answer is obtained in step 103, then the routine terminates.

If a YES answer is obtained in step 102 meaning that the emergency running mode flag XCLIMP indicates one (1), that is, that the vehicle is in the emergency running mode, then the routine proceeds to step 105 wherein it is determined whether a failure flag XOCNTF indicating a failure of the crank sensor 10 is zero (0) or not. If a YES answer is obtained meaning that the crank sensor 10 has been repaired, and the vehicle has returned to a normal running mode from the emergency running mode, then the routine proceeds to step 106 wherein the current crank angle is 30° or not. If a YES answer is obtained, then the routine proceeds to step 107 wherein the emergency running mode flag XCLIMP is reset to zero (0). The routine proceeds to step 104 wherein the ISN30S operation is performed by time interrupt at an interval of 30° CA. Alternatively, if a NO answer is obtained in step 105 or 106, then the routine terminates.

FIG. 3 shows the ISN30S operation executed in step 104 of FIG. 2 at an interval of 30° CA. Step 111 performs an ignition timing control operation. Step 112 performs a fuel injection control operation. Step 113 performs other control operations to be executed in synchronism with revolution of the engine.

Figure 4:
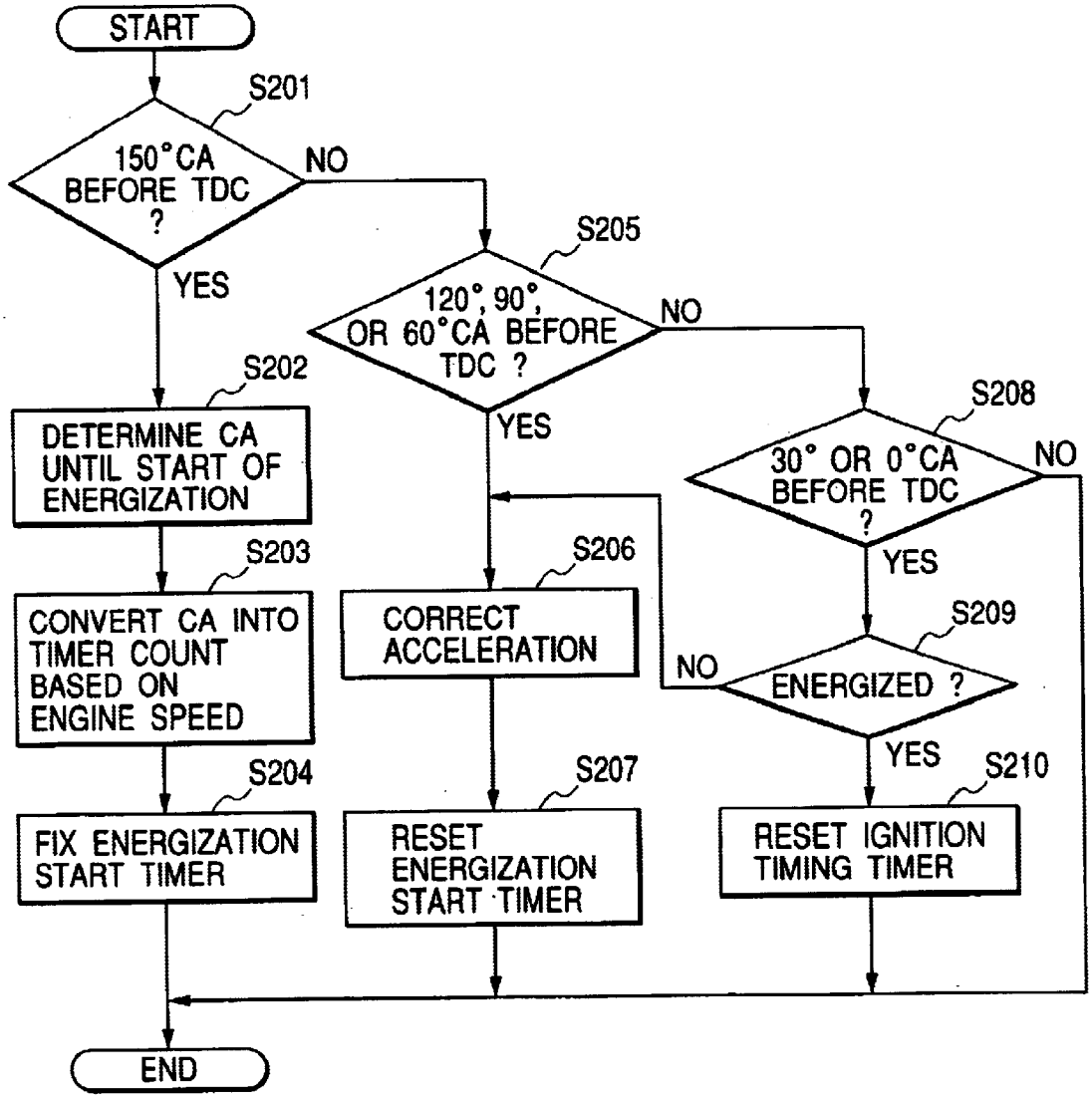
FIGS. 4 and 5 show a flowchart of an ignition timing control program to be executed in the engine control system of FIG. 1.
Figure 5:
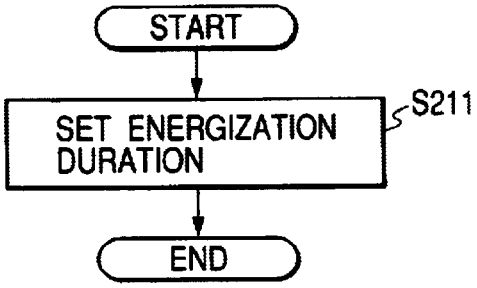

FIGS. 4 and 5 show the ignition timing control operation executed in step 111 of FIG. 3 by the CPU 51 of the microcomputer 50 in the ECU 40. A sequence of steps in FIG. 4 are carried out at an interval of 30° CA for each cylinder of the engine. A step in FIG. 5 is carried out by interrupt at the time of start of energization of an ignition coil for each cylinder of the engine.

First, in step 201, it is determined whether the current crank angle CA is 150° before the top dead center (TDC) of the piston of the engine or not. If a YES answer is obtained, then the routine proceeds to step 202 wherein a crank angle (° CA) between a current angular position and an angular position of the crank shaft 1 at which the ignition coil is to be energized by the igniter is calculated. The routine proceeds to step 203 wherein the crank angle (° CA) determined in step 202 is converted into a timer count based on the current speed NE of the engine. The routine proceeds to step 204 wherein an energization starting timer CAT is set to the timer count value derived in step 203 and then terminates.

Alternatively, if a NO answer is obtained in step 201 meaning that the current crank angle is not 150° before the top dead center, then the routine proceeds to step 205 wherein it is determined whether the current crank angle is one of 120°, 90°, and 60° before the top dead center or not. If a YES answer is obtained meaning that the current crank angle is either of 120°, 90°, and 60° before the top dead center, then the routine proceeds to step 206 wherein the count value of the energization starting timer CAT is corrected by the current acceleration value of the engine. The routine proceeds to step 207 wherein the energization starting timer CAT is set to the count value corrected in step 206 and then terminates.

If a NO answer is obtained in step 205 meaning that the current crank angle is none of 120°, 90°, and 60° before the top dead center, then the routine proceeds to step 208 wherein it is determined whether the current crank angle is 30° or 0° before the top dead center. If a YES answer is obtained meaning that the current crank angle is either of 30° and 0° before the top dead center, then the routine proceeds to step 209 wherein the ignition coil is being energized by the igniter or not. If a NO answer is obtained meaning that the ignition coil is not being energized, then the routine proceeds to step 206. Alternatively, if a YES answer is obtained, then the routine proceeds to step 210 wherein an ignition timing timer, as will be described later, is reset and then terminates. If a NO answer is obtained in step 208, then the routine terminates.

When the count value set in the energization starting timer CAT is reached, an energization starting operation in step 211 of FIG. 5 is executed. Specifically, a timer count equivalent to an energization duration is set in the ignition timing timer.

Figure 6:
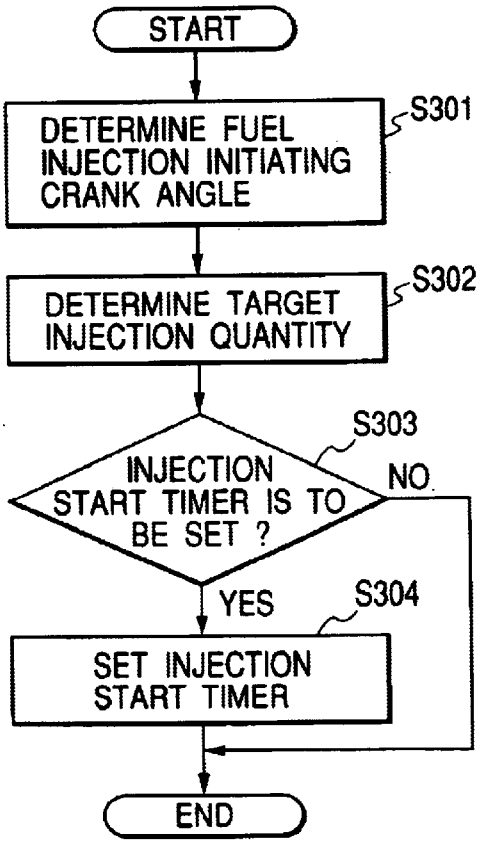
FIGS. 6 and 7 show a flowchart of a fuel injection control program to be executed in the engine control system of FIG. 1.
Figure 7:
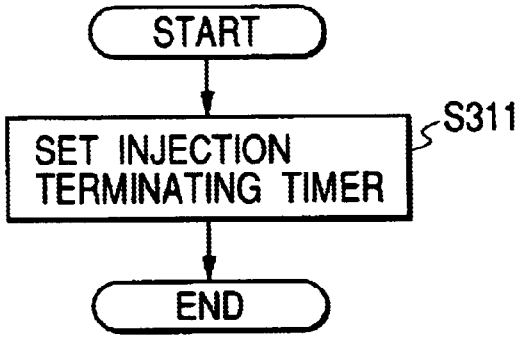

FIGS. 6 and 7 show the fuel injection control operation executed in step 112 of FIG. 3 by the CPU 51 of the microcomputer 50 in the ECU 40. A sequence of steps in FIG. 6 are carried out at an interval of 30° CA for each cylinder of the engine. A step in FIG. 5 is carried out by interrupt at the time of start of fuel injection.

First, in step 301, a crank angle before the top dead center of the piston of each cylinder at which the fuel injection is to be initiated is determined. The routine proceeds to step 302 wherein a target quantity TAU of fuel to be injected by the fuel injector into the engine is calculated. The routine proceeds to step 303 wherein it is determined whether a time when an injection starting timer DGINJSD is to be set has been reached or not. If a YES answer is obtained, then the routine proceeds to step 304 wherein a timer count at which the fuel injection is to be initiated, that is, which corresponds to the crank angle determined in step 301 is set in the injection starting timer DGINJSD. If a NO answer is obtained in step 303, then the routine terminates.

When the fuel injection is started in the operation of FIG. 6, step 311 of FIG. 7 is executed. Specifically, an injection terminating timer count determined as a function of the injection quantity TAU determined in step 302 is set in an injection terminating timer.

Figure 8:
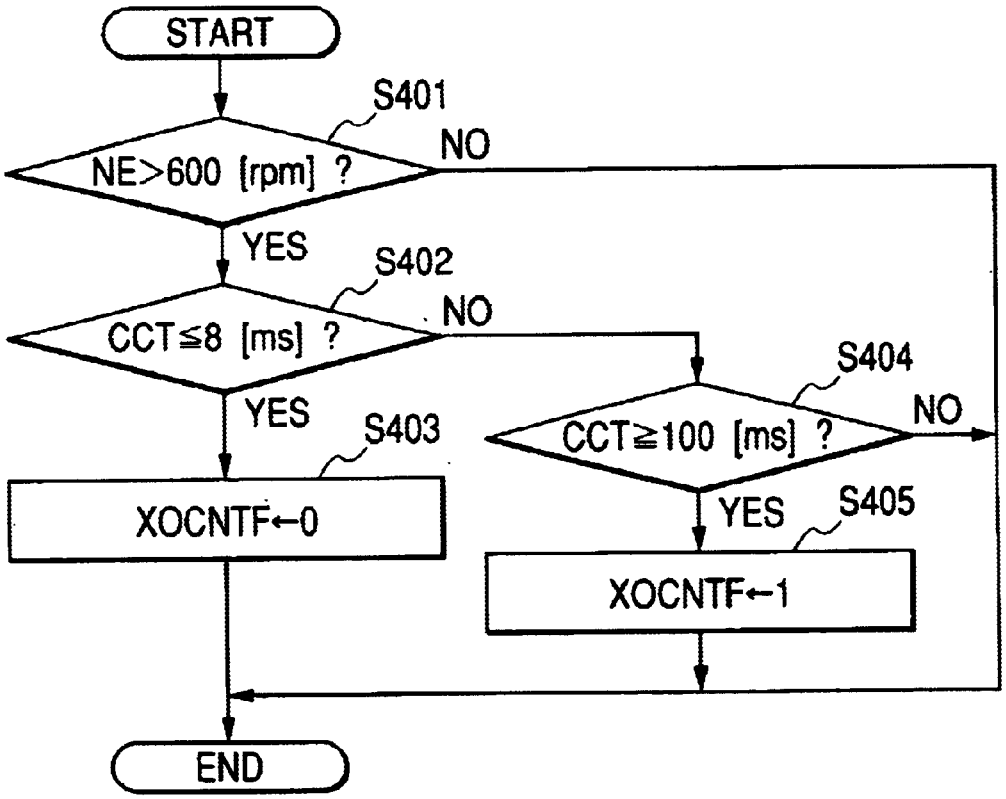
FIGS. 8, 9, and 10 show a flowchart of a failure decision program for determining whether a failure of a crank sensor has occurred or not.

The manner of determining whether the crank sensor 10 has malfunctioned or not will be described below with reference to FIGS. 8, 9, and 10. Operations in FIGS. 8, 9, and 10 are performed in the CPU 51 in the microcomputer 50 of the ECU 40 at intervals of 16 ms, 8 ms, and 10° CA, respectively.

Figure 11:
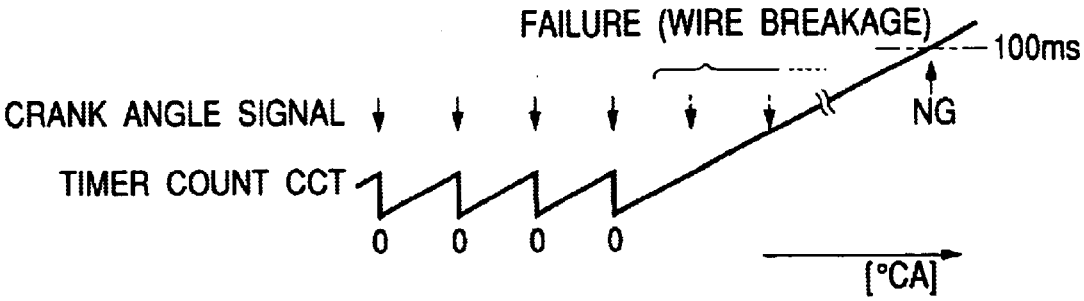
FIG. 11 is a time chart which shows a relation between a crank signal and a timer count CCT in the even of a failure of a crank sensor.

First, in step 401, it is determined whether the engine speed NE is greater than 600 rpm or not. If a NO answer is obtained, then the routine terminates. Alternatively, if a YES answer is obtained meaning that the engine is running in a normal state, then the routine proceeds to step 402 wherein it is determined whether a timer count CCT which is reset to zero (0), as shown in FIG. 11, upon input of the crank angle signal indicates 8 ms or less. If a YES answer is obtained meaning that a correct crank angle signal is outputted from the crank sensor 10, the routine proceeds to step 403 wherein the failure flag XOCNTF is set to zero (0) and terminates. Alternatively, if a NO answer is obtained in step 402, then the routine proceeds to step 404 wherein it is determined whether the timer count CCT is 100 ms or more. If a YES answer is obtained meaning that the timer count CCT is longer than 100 ms, that is, that a failure, as clearly shown in FIG. 11, has occurred, then the routine proceeds to step 405 wherein the failure flag XOCNTF is set to one (1)

indicating the failure of the crank sensor 10. If a NO answer is obtained in step 404, then the routine terminates. Note that a decision criterion of 100 ms used in step 404 may be changed as a function of an engine load, i.e., the engine speed NE.

Figure 9:
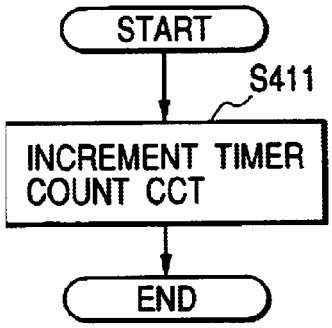
Figure 10:
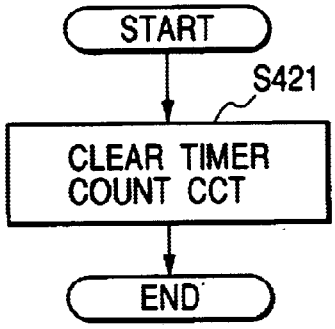

The timer count CCT used in steps 402 and 404 is incremented in step 411 of FIG. 9 at an interval of 8 ms and reset to zero (0) in step 421 of FIG. 10 upon input of the crank angle signal produced by the crank sensor 10 at an interval of 10° CA.

A fail-safe operation will be described below with reference to FIGS. 12, 13, 14, and 15 which is executed upon input of one of the first and second cam signals from the first and second cam sensors 20 and 30 in a case where the failure has occurred in the crank sensor 10.

Figure 12:
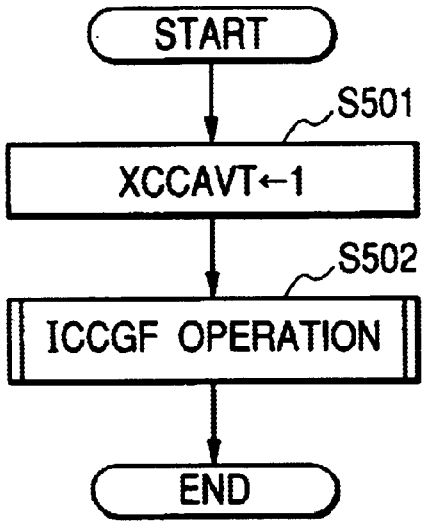
FIG. 12 shows a flowchart of a control task initiating program to be triggered upon input of a first cam signal.

Upon input of the first cam signal from the first cam sensor 20, an operation in FIG. 12 is initiated. Specifically, in step 501, a flag XCCAVT is set to one (1) meaning that the first cam signal has been inputted to the ECU 40. The routine proceeds to step 502 wherein a fail-safe operation ICCGF, as will be described later in detail, is executed.

Figure 13:
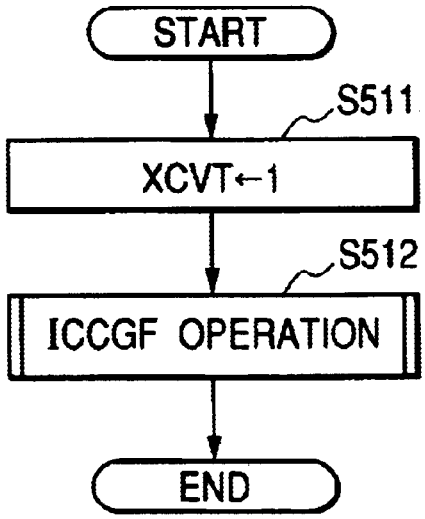
FIG. 13 shows a flowchart of a control task initiating program to be triggered upon input of a second cam signal.

Similarly, upon input of the second cam signal from the second cam sensor 30, an operation in FIG. 13 is initiated. Specifically, in step 511, a flag XCVT is set to one (1) meaning that the second cam signal has been inputted to the ECU 40. The routine proceeds to step 512 wherein the fail-safe operation ICCGF is executed.

Figure 14:
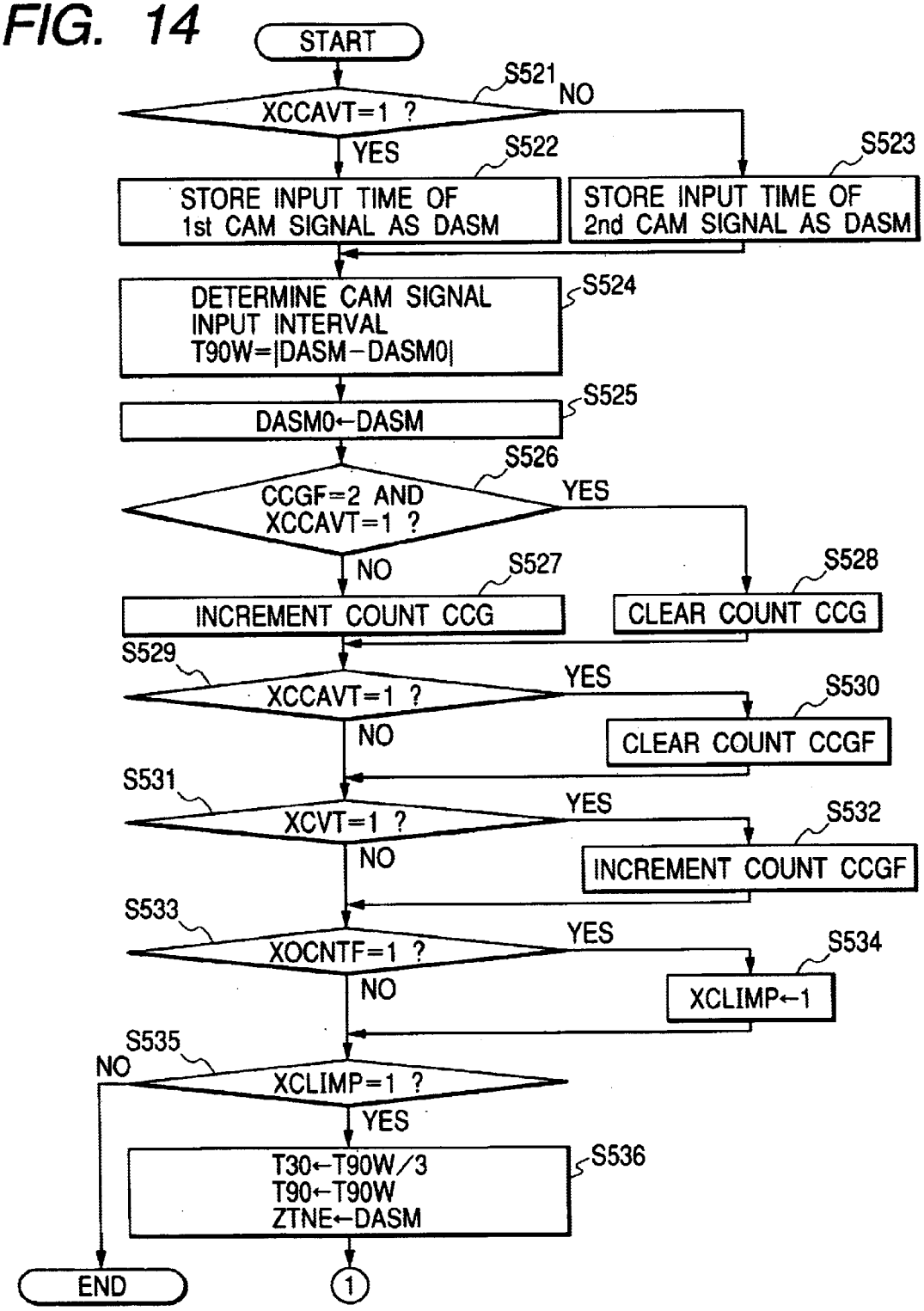
FIGS. 14 and 15 show a flowchart of a control task initiating sub-program to be executed in each of the programs of FIGS. 12 and 13.
Figure 18:
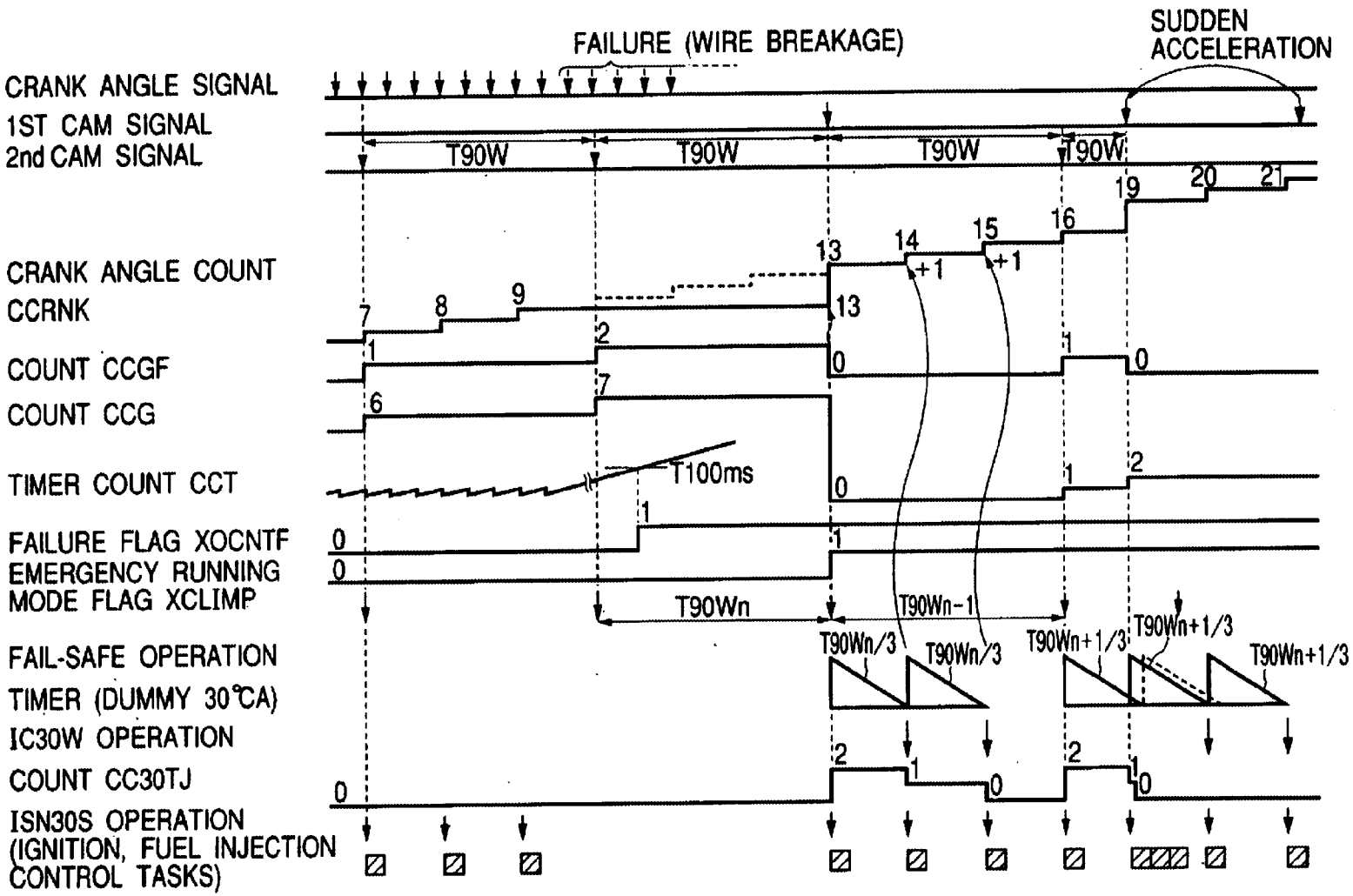
FIG. 18 is a time chart which shows an operation of the engine control system of FIG. 1 in the event of a failure of a crank sensor.

The fail-safe operation ICCGF will be described below in detail with reference to FIGS. 14, 15, and 18. FIG. 18 shows time-sequential variation in control parameters when the crank sensor 10 has failed.

First, in step 521, it is determined whether the flag XCCAVT indicating whether the first cam signal has been inputted or not is one (1) or not. If a YES answer is obtained meaning that the first cam signal has been inputted, then the routine proceeds to step 522 wherein an input time when the first cam signal has been inputted is stored in a given memory location as an input time DASM. Alternatively, if a NO answer is obtained meaning that the flag XCCAVT is zero (0), then the routine proceeds to step 523 wherein an input time when the second cam signal has been inputted is stored in the given memory location as the input time DDASM.

After step 522 or 523, the routine proceeds to step 524 wherein a cam signal input time interval T90W is calculated using the following equation.

$$T90W=|DASM-DASMO| \quad (1)$$

where DASMO denotes a time when the first or second cam signal was inputted one program cycle earlier.

The routine proceeds to step 525 wherein the input time DASM derived in step 522 or 523 is stored as the input time DASMO. The routine proceeds to step 526 wherein it is determined whether or not a counter value CCGF, as shown in FIG. 18, is two (2), and, at the same time, the flag XCCAVT is one (1) indicating that the first cam signal has been inputted. If a NO answer is obtained, then the routine proceeds to step 527 wherein a counter value CCG, as shown in FIG. 18, is incremented by one (1). Alternatively, if a YES answer is obtained, then the routine proceeds to step 528 wherein the counter value CCG is reset to zero (0). In this way, the counter value CCG indicating a reference cylinder position is determined based on the first cam signal or the second cam signal.

The routine proceeds to step 529 wherein the flag XCCAVT is one (1) or not indicating the first cam signal has been inputted. If a YES answer is obtained, then the routine proceeds to step 530 wherein a timer count CCGF is cleared to zero (0) (see FIG. 18). Alternatively, if a NO answer is obtained, then the routine proceeds directly to step 531 wherein it is determined whether the flag XCVT is one (1) or not. If a YES answer is obtained meaning that the second cam signal has been inputted, then the routine proceeds to step 532 wherein the counter value CCGF is incremented. Alternatively, if a NO answer is obtained, then the routine proceeds directly to step 533.

In step 533, it is determined whether the failure flag XOCNTF is one (1) or not. If a YES answer is obtained meaning that any failure such as wire breakage has occurred in the crank sensor 10, so that no signal is outputted from the crank sensor 10, then the routine proceeds to step 534 wherein the emergency running mode flag XCLIMP is set to one (1). Alternatively, if a NO answer is obtained, then the routine proceeds directly to step 535 wherein it is determined whether the emergency running mode flag XCLIMP is one (1) or not. If a NO answer is obtained meaning that the crank sensor 10 is in service, and the vehicle is not in the emergency running mode, then the routine terminates. Alternatively, if a YES answer is obtained meaning that the crank sensor 10 is malfunctioning, and the emergency running mode flag XCLIMP indicates one (1), then the routine proceeds to step 536 wherein one-third (⅓) of the cam signal input time interval T90W, as determined in Eq. (1) as a 30° CA time required as a trigger for initiating the ISN30S operation (i.e., the ignition timing control and the fuel injection control) is defined as a crank signal input time interval T30, and the cam signal input time interval T90W is stored in the memory as a cam signal input time interval T90. Specifically, when the crank sensor 10 is not in service, the crank signals are not outputted at an angular interval of 10° CA, therefore, a 90° CA time interval between inputs of the first and/or second cam signals is used to define one-third thereof as a dummy 30° CA time interval. Additionally, the input time DASM of the first or second cam signal is stored in a given memory location as the interrupt time ZTNE, as referred to in step 101 of FIG. 2, that is a reference set time of the ignition and fuel injection timers used in steps 204, 207, 304, etc.

Figure 15:
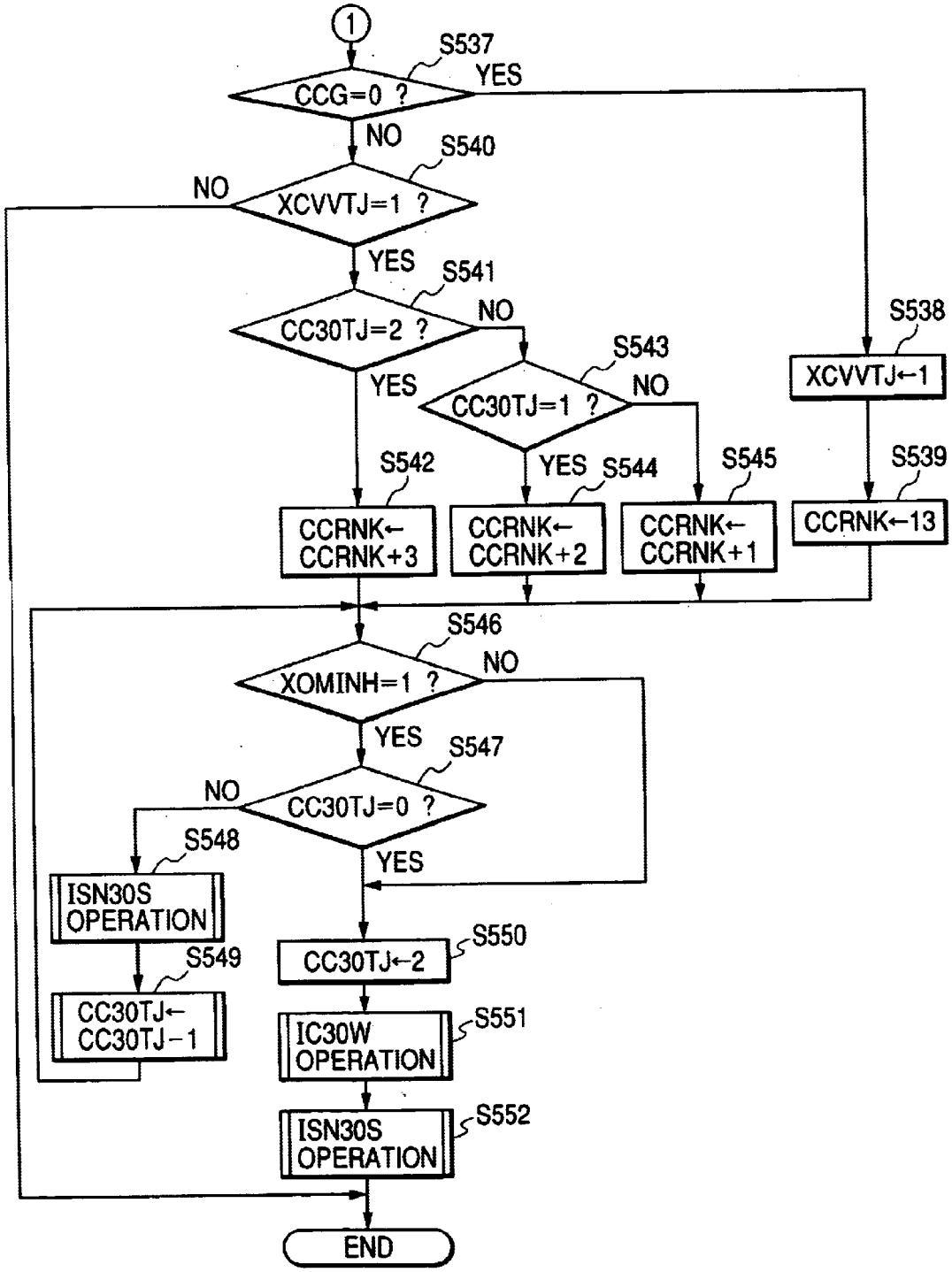

After step 536, the routine proceeds to step 537 of FIG. 15 wherein it is determined whether the counter value CCG is zero (0) or not. If a YES answer is obtained meaning that the reference cylinder position is reached in the emergency running mode, then the routine proceeds to step 538 wherein a cylinder discrimination flag XCVVTJ is set to one (1) indicating that the reference cylinder has been discriminated using the first and second cam signals from the first and second cam sensors 20 and 30. The routine proceeds to step 539 wherein the crank angle counter value CCRNK is, as shown in FIG. 18, set to thirteen (13) at the same time as the cylinder discrimination flag XCVVTJ is set to one (1). Alternatively, if a NO answer is obtained in step 537 meaning that the reference cylinder position is not yet reached in the emergency running mode, then the routine proceeds to step 540 wherein it is determined whether the cylinder discrimination flag XCVVTJ is one (1) or not. If a NO answer is obtained meaning that the reference cylinder is not yet discriminated using the first and second cam sensors 20 and 30, then the routine terminates. In this embodiment, when the counter value CCG indicates zero (0), it is determined that the reference cylinder position has been reached, but however, such a determination may be made when the counter value CCG indicates another value.

Alternatively, if a YES answer is obtained in step 540 meaning that the cylinder discrimination flag XCVVTJ indicates one (1), and the reference cylinder has been discriminated using the first and second cam signals from the first and second cam sensors 20 Ad and 30, then the routine proceeds to step 541 wherein it is determined whether a counter value CC30TJ is two (2) or not. The counter value CC30TJ, as clearly shown in FIG. 18, continues indicating zero (0) when the crank sensor 10 is in service, while it is set to two (2) upon input of the first or second cam signal when the emergency running mode flag XCLIMP is one (1) and decremented each time an IC30W operation, as will be described later in detail, is carried out at the dummy 30° CA time interval. If a YES answer is obtained in step 541 meaning that the engine has been accelerated during the emergency running mode, and the IC30W operation has not been performed at all by interrupt at the dummy 30° CA time interval within an interval of 90° CA (i.e., T90W, then the routine proceeds to step 542 wherein the crank angle counter value CCRNK is, as shown in FIG. 18, incremented by three (3) for establishing matching with the reference cylinder position in the emergency running mode.

Alternatively, if a NO answer is obtained in step 541 meaning that the counter value CC30TJ is not two (2), then the routine proceeds to step 543 wherein it is determined whether the counter value CC30TJ is one (1) or not. If a YES answer is obtained meaning that the engine has been accelerated in the emergency running mode, and the IC30W operation has been executed only one time by interrupt at the dummy 30° CA time interval within an interval of 90° CA, then the routine proceeds to step 544 wherein the crank angle counter value CCRNK is incremented by two (2) for establishing matching with the reference cylinder position in the emergency running mode. Alternatively, if a NO answer is obtained in step 543 meaning that the IC30W operation, like in the normal mode, has been executed two times by interrupt at the dummy 30° CA time interval within an interval of 90° CA, the routine proceeds to step 545 wherein the crank angle counter value CCRNK is incremented by one (1) for establishing matching with the reference cylinder position in the emergency running mode.

After step 542, 544, 545, or 539, the routine proceeds to step 546 wherein it is determined whether a control task dropout avoidance flag XOMINH is one (1) or not. The control task dropout avoidance flag XOMINH is to be set to one (1) when it is required to produce a trigger for initiating the ISN30S operation immediately after input of the first or second cam signals in the event that the number of times (two in this embodiment) the ISN30S operation, as shown in FIG. 3, should be executed, in sequence, at the dummy 30° CA time interval following a previous input of the first or second cam signal is not yet reached. If a YES answer is obtained in step 546 meaning that the control task dropout avoidance flag XOMINH is one (1), so that it is required to produce a trigger for initiating the ISN30S operation immediately upon input of the first or second cam signal, then the routine proceeds to step 547 wherein it is determined whether the counter value CC30TJ is zero (0) or not. If a NO answer is obtained meaning that the ISN30S operation has not been executed a given number of times (i.e., two times in this embodiment) at the dummy 30° CA time interval within an interval between two consecutive inputs of the first and/or second cam signals, then the routine proceeds to step 548 wherein a control task trigger is produced to initiate the JSN30S operation, as shown in FIG. 3. The routine then proceeds to step 549 wherein the counter value CC30TJ is decremented by one (1) and returns back to step 546. Specifically, if the engine is accelerated rapidly, and, for example as illustrated on the right side of FIG. 18, an input of the first cam signal is shifted from a broken line to a solid line, so that the cam signal input time interval T90W is shortened, thereby causing the ISN30S operation not to be executed two times at the dummy 30° CA time interval following a previous input of the first or second cam signal, then the ISN30S operation is executed immediately the same number of times as that the ISN30S operation has not yet been executed at the dummy 30° CA time interval.

Figure 19:
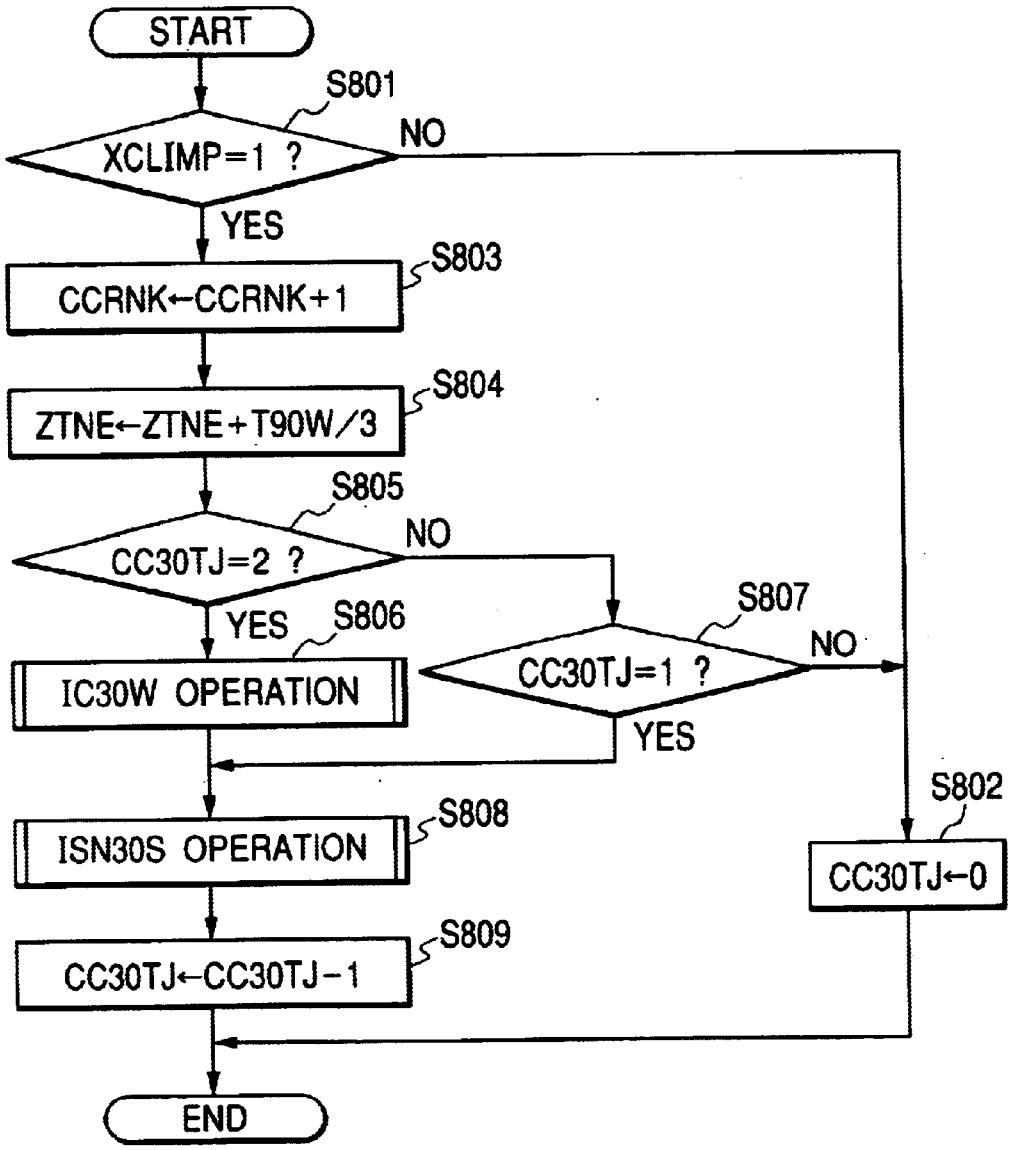
FIG. 19 shows a flowchart of a control task initiating sub-program for initiating the control tasks of FIG. 3 at a dummy crank angle interval in the event of a failure of a crank sensor.

Alternatively, if a YES answer is obtained in step 547 meaning that the counter value CC30TJ is zero (0), or if a NO answer is obtained in step 546 meaning that it is unnecessary to initiate the ISN30S operation immediately, that is, that the ISN30S operation has been performed two times at the dummy 30° CA time interval within a previous T90W interval, then the routine proceeds to step 550 wherein the counter value CC30TJ is reset to two (2). The routine proceeds to step 551 wherein a timer count for defining a start time at which an IC30W operation, as will be described later with reference to FIG. 19, is to be initiated in order to execute the JSN30S operation subsequently at the dummy 30° CA time interval is set to the dummy 30° CA time after the input of the first or second cam signal (=ZTNE+T90W/3).

The routine proceeds to step 552 wherein the ISN30S operation, as described in FIG. 3, is initiated and then terminates. The execution of the ISN30S in step 552 is achieved upon input of the first or second cam signal.

Figure 16:
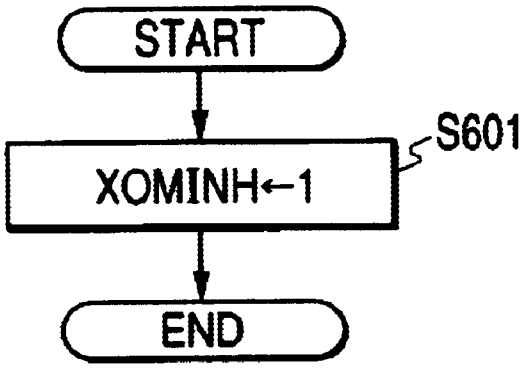
FIG. 16 shows a flowchart of a control task dropout avoidance flat setting program.

FIG. 16 shows a control task dropout avoidance flag setting program which is started in the CPU 51 at an initializing stage immediately following turning on of an ignition switch (not shown) of the vehicle and executed at an interval of 1 sec.

After entering the program, the routine proceeds to step 601 wherein the control task dropout avoidance flag XOMINH is set to one (1) and then terminates. Specifically, the control task dropout avoidance flag XOMJNH is kept at one (1) after the ignition switch is turned one.

Figure 17:
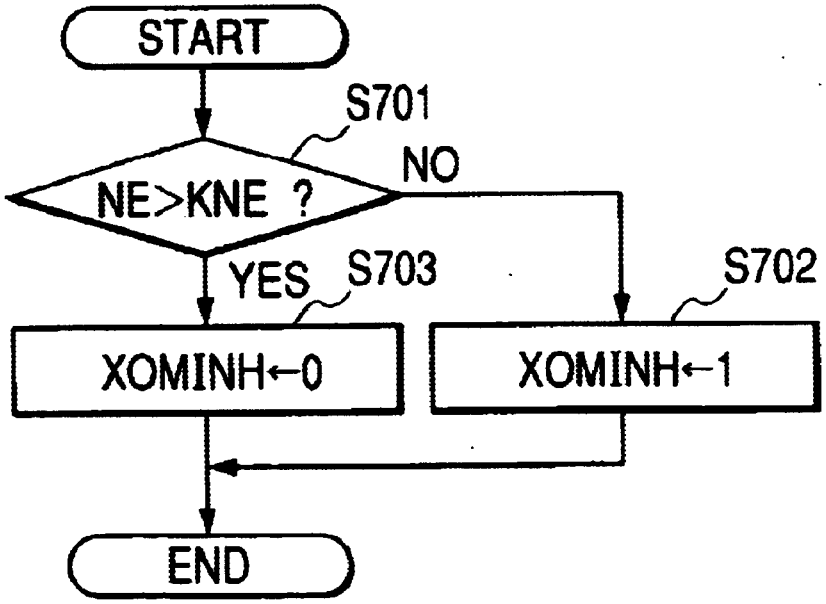
FIG. 17 shows a flowchart of a modification of the control task dropout avoidance flat setting program in FIG. 16.

FIG. 17 shows a modification of the control task dropout avoidance flag setting program of FIG. 16 which is executed in the CPU 51 at an interval of 8 ms.

First, in step 701, it is determined whether the engine speed NE is greater than a given reference value KNE or not. The given reference value KNE may be set to a low speed value for each type of vehicles. If a NO answer is obtained meaning that the engine speed KNE lies within a low speed range, for example, in an idle mode of engine operation, then the routine proceeds to step 702 wherein the control task dropout avoidance flag XOMINH is set to one (1) and terminates. Alternatively, if a YES answer is obtained meaning that the engine speed KNE lies within a high speed range, then the routine proceeds to step 703 wherein the control task dropout avoidance flag XOMINH is set to zero (0) and terminates. Specifically, the control task dropout avoidance flag XOMJNH is determined depending upon the degree of a control load.

FIG. 19 shows the IC30W operation to initiate the ISN30S operation, in sequence, at the dummy 30° CA time interval following execution of the ISN30S operation upon input of the first or second cam signal. This program is initiated when the timer count defined in step 551 of FIG. 15 expires, that is when the dummy 30° CA time has passed after input of the first or second cam signal.

After entering the program, the routine proceeds to step 801 wherein it is determined whether the emergency running mode flag XCLIMP is one (1) or not. If a NO answer is obtained meaning that the crank sensor 10 is in service, then the routine proceeds to step 802 wherein the counter value CC30TJ is set to zero (0) and terminates. Alternatively, if a YES answer is obtained meaning that the crank sensor 10 is malfunctioning, then the routine proceeds to step 803 wherein the crank angle counter value CCRNK is incremented by one (1).

The routine proceeds to step 804 wherein one-third of the cam signal input time interval T90W is added to the interrupt time ZTNE. The routine proceeds to step 805 wherein it is determined whether the counter value CC30TJ indicates two (2) or not. If a YES answer is obtained meaning that the counter value CC30TJ indicates two (2), and a first one of the ISN30S operations to be executed at the dummy 30° CA time interval after input of the first and second cam signal has not yet been completed, then the routine proceeds to step 806 wherein a timer count for triggering the second ISN30S operation a dummy 60° CA time (i.e., two times the dummy 30° CA time) after the input of the first or second cam signal is set to the interrupt time ZTNE determined in step 804. The routine proceeds to step 808 wherein the first ISN30S operation to be executed the dummy 30° CA time after input of the first and second cam signal is initiated.

If a NO answer is obtained in step 805, then the routine proceeds to step 807 wherein it is determined whether the counter value CC30TJ is one (1) or not. If a NO answer is obtained, then the routine proceeds to step 802 wherein the counter value CC30TJ is, as described above, set to zero (0) and terminates.

After step 806 or if a YES answer is obtained in step 807 meaning that the counter value CC30TJ is one (1), and the first ISN30S operation has been completed the dummy 30° CA time after the input of the first or second cam signal, the routine proceeds to step 808 wherein the second ISN30S operation to be executed the dummy 60° CA time after input of the first or second cam signal is initiated. The routine proceeds to step 809 wherein the counter value CC30TJ is decremented by one and then terminates.

As apparent from the above discussion, the engine control system of the invention is designed to execute given control tasks at a 30° angular interval of rotation of the crank shaft 1 as determined by an interval between sequential inputs of the crank angle signals from the crank sensor 10. If the crank sensor 10 has malfunctioned, it becomes impossible to determine the 30° angular interval of the crank shaft 1 using the crank angle signals. The engine control system, thus, works to calculate one-third of an interval (i.e., a 90° crank angle) between consecutive inputs of the first and/or second cam signals to define the dummy 30° crank angle (CA) as a trigger for initiating the control tasks. If either of the first and second cam signals is inputted before the number of times (two in this embodiment) the control tasks should be executed, in sequence, at an interval of the dummy 30° CA is not yet reached due to, for example, sudden acceleration of the engine, each of the control tasks is executed immediately the same number of times as that the control task has not yet been executed at the dummy 30° CA time interval, thereby achieving execution of the control tasks a required number of times between two consecutive outputs of the first and/or second cam signals to ensure the stability of an operating condition of the engine in the emergency running mode. Even if the number of times the control tasks are to be executed at an interval of dummy 30° CA is two, the engine control system may alternatively be designed to produce at least one trigger for initiating each of the control tasks after the control task is executed upon input of the first or second cam signal.

The above discussion refers to a case where the engine control system works to perform the control tasks in synchronism with revolution of the V-type four-cycle eight-cylinder engine and has two cam sensors one for each bank of four cylinders. Specifically, the engine control system is designed to initiate the control tasks at an interval of 30° CA and define one-third of an interval of consecutive inputs of signals from either or both of the cam sensors as the dummy 30° CA if a failure has occurred in the crank sensor 10, but however, the invention may be used with in-line four-cycle four-cylinder engines equipped with a cam sensor designed to provide an output in a cycle of a multiple of an interval at which a control task is to be initiated cyclically which output may be used to discriminate cylinders of the engine.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A control apparatus for an internal combustion engine comprising:

a crank sensor responsive to rotation of a crank shaft of an internal combustion engine to output a crank signal at a first angular interval of the rotation of the crank shaft;

a cam sensor responsive to rotation of a cam shaft of the engine to output a cam signal at a second angular interval of the rotation of the cam shaft which is a given multiple of the first angular interval of the rotation of the crank shaft;

a crank sensor failure detecting circuit detecting a failure of said crank sensor to provide a failure signal indicative thereof;

a control circuit executing a given control task cyclically in synchronism with rotation of the engine; and a control task start time defining circuit working to define a crank signal-triggered control task start time at which said given control task is to be initiated cyclically in said control circuit as a function of an interval between sequential inputs of the crank signals from said crank sensor, said control task start time defining circuit being responsive to the failure signal from said crank sensor failure detecting circuit to define a cam signal-triggered control task start time at which said given control task is to be initiated every input of the cam signal from said cam sensor and also to define a given fraction of an interval between sequential inputs of the cam signals as a dummy crank signal-triggered control task start time interval at which said given control task is to be executed following the input of the cam signal, if the cam signal is inputted before the number of times the control task is to be executed cyclically at the dummy crank signal-triggered control task start time interval is not yet reached, said control task start time defining circuit producing at least one trigger to initiate the given control task after execution of the given control task upon the input of the cam signal.

2. An engine control apparatus as set forth in claim 1, wherein if the cam signal is inputted before the number of times the control task is to be executed cyclically at the dummy crank signal-triggered control task start time interval is not yet reached, said control task start time defining circuit produces triggers in response to the input of the cam signal to initiate the given control task the same number of times as that the given control task is not yet executed at the dummy crank signal-triggered control task start time interval.

3. An engine control apparatus as set forth in claim 1, wherein said control task start time defining circuit defines the dummy crank signal-triggered control task start time interval when a speed of the engine is less than a given value.

4. An engine control apparatus as set forth in claim 1, wherein said control task start time defining circuit prohibits defining the dummy crank signal-triggered control task start time interval when a speed of the engine is higher than a given value.

* * * * *